US010899143B2

(12) United States Patent
Yoda

(10) Patent No.: US 10,899,143 B2
(45) Date of Patent: Jan. 26, 2021

(54) HEATING APPARATUS, MEDIUM PROCESSING APPARATUS, AND MEDIUM PROCESSING METHOD

(71) Applicant: SEIKO EPSON CORPORATION, Tokyo (JP)

(72) Inventor: Tomohiro Yoda, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/145,476

(22) Filed: Sep. 28, 2018

(65) Prior Publication Data

US 2019/0100034 A1 Apr. 4, 2019

(30) Foreign Application Priority Data

Sep. 29, 2017 (JP) ..... 2017-191633

(51) Int. Cl.
*B41J 11/00* (2006.01)

(52) U.S. Cl.
CPC ..... *B41J 11/002* (2013.01); *B41J 11/0015* (2013.01)

(58) Field of Classification Search
CPC ..... B41J 11/002; B41J 11/0015; B41M 7/009
See application file for complete search history.

(56) References Cited

U.S. PATENT DOCUMENTS 5,020,244 A * 6/1991 Smith ..... B41J 11/002 34/633
2010/0103237 A1* 4/2010 Hara ..... B41J 3/543 347/102
2012/0249703 A1* 10/2012 Nishimura ..... B41J 11/002 347/102
2016/0159111 A1 6/2016 Sasaki
2016/0332462 A1* 11/2016 Harayama ..... B41J 11/0015

FOREIGN PATENT DOCUMENTS

JP 2016-107469 A 6/2016

* cited by examiner

*Primary Examiner* — Henok D Legesse
(74) *Attorney, Agent, or Firm* — Workman Nydegger

(57) ABSTRACT

A recording apparatus includes a support surface configured to support the medium and positioned downstream than the recording unit in a transporting direction in which a medium to which a liquid impinged by the recording unit is transported, a heating unit configured to heat the medium supported by the support surface, a flow channel including an inlet and an outlet opening toward the support surface, and a blower disposed in the flow channel and configured to allow a gas entering via the inlet to be blown out from the outlet. The inlet opens to allow at least some of the gas blown from the outlet to enter. The outlet is nearer to the recording unit than the inlet is, and its blowing direction goes toward at least an inlet side in a direction along the support surface.

12 Claims, 3 Drawing Sheets

HEATING APPARATUS, MEDIUM PROCESSING APPARATUS, AND MEDIUM PROCESSING METHOD

CROSS-REFERENCE TO RELATED APPLICATIONS

The present application claims priority to Japanese Patent Application No. 2017-191633, filed Sep. 29, 2017, which is hereby incorporated by reference in its entirety.

BACKGROUND

Embodiments of the invention relate to a heating apparatus, a medium processing apparatus, and a method for processing a medium.

JP-A-2016-107469 describes, as an example of a medium processing apparatus, a medium drying apparatus configured to heat a medium onto which a liquid, such as an ink, has been ejected from a recording head, and to dry the medium. The medium drying apparatus includes an infrared ray heater configured to heat the medium, a spraying unit configured to spray a gas onto the medium, and a liquid separator configured to remove vapor generated from the medium through heating.

SUMMARY

In the medium drying apparatus, when the spraying unit sprays the gas onto the medium, vapor generated from the medium may flow to the to the recording head and/or to the outside of the apparatus. When the vapor flows from the medium drying apparatus to the recording head, the vapor may impair ejection performance of the recording head.

An advantage of the disclosure is to provide a heating apparatus, a medium processing apparatus, and a medium processing method, each configured to suitably discharge vapor generated from a medium.

A medium processing apparatus according to embodiments of the invention includes a support surface configured to support a medium. The support surface supports the medium in a transporting direction in which a medium is transported. A recording unit ejects liquid onto the medium such that the liquid adheres to the medium. The support surface is downstream, with respect to the transporting direction, of the recording unit. The medium processing apparatus also includes a heating unit configured to heat the medium supported by the support surface, a flow channel having an inlet and an outlet opening toward the support surface, and a blower disposed in the flow channel and configured to allow a gas entering via the inlet to blow from the outlet. The inlet opens to allow at least some of the gas blowing from the outlet to enter. Thus, at least some of the air blown out of the outlet is circulated. The outlet is on a side of the recording unit with respect to the inlet, and, in a blowing direction, faces a side of the inlet in a direction along the support surface.

The gas blows from the outlet toward the inlet locating opposite to the recording unit. Thus, the inlet is positioned farther away from the recording unit than the outlet. For this reason, the gas blowing from the outlet causes vapor generated from the medium through heating by the heating unit to flow toward an area opposite to or away from the recording unit along the support surface, to pass through between the inlet and the support surface, and to discharge to the outside of the apparatus. Thus, the vapor passes through an opening or a space between the inlet and the support surface and is discharged to the outside of the apparatus. According to the disclosure, when the recording unit locates the side of the outlet with respect to a region heated by the heating unit, vapor generated from a medium may be less likely to flow from the region heated by the heating unit toward the recording unit. The vapor is thus suitably discharged.

In the medium processing apparatus described above, the inlet may open toward a side of the outlet.

According to the configuration, the gas blowing from the outlet easily enters, via the inlet, into the flow channel. For this reason, some of the gas heated by the heating unit passes through the flow channel and circulates inside the apparatus. Meanwhile, the gas blowing from the outlet presses vapor generated from the medium supported by the support surface onto the support surface to allow the vapor to flow and be discharged to the outside of the apparatus. With improved heat efficiency, this feature suitably allows the vapor to be discharged.

In the medium processing apparatus described above, the inlet may be provided with a guide face inclining relative to the support surface and extending toward a side of the outlet.

According to the configuration, the guide face guides the gas blowing from the outlet upward to allow the gas to easily enter into the inlet. For this reason, some of the gas heated by the heating unit passes through the flow channel and circulates inside the apparatus. Meanwhile, the gas blowing from the outlet presses vapor generated from the medium supported by the support surface onto the support surface to allow the vapor to flow and be discharged to the outside of the apparatus. With improved heat efficiency, this feature suitably allows the vapor to be discharged.

In the medium processing apparatus described above, the heating unit may be disposed between the outlet and the inlet.

According to the configuration, the gas blowing from the outlet passes through the region heated by the heating unit. For this reason, the heating unit effectively heats the gas blowing from the outlet. This feature thus improves heat efficiency.

In the medium processing apparatus described above, the outlet may have a smaller opening area than the inlet.

According to the configuration, a velocity of the gas blowing from the outlet is increased relative to the velocity of the gas entering the inlet. For this reason, vapor generated from the medium may be less likely to be discharged to the outside of the apparatus from the side of the outlet.

In the medium processing apparatus described above, a housing configured to accommodate the heating unit is included. The inlet includes a first wall member configuring a part of the housing, a second wall member located on a side of the outlet than the first wall member and configuring a part of the housing, and side wall members intersecting with the first wall member and the second wall member and configuring parts of the housing. The side wall members may extend up to a position closer to the support surface than the second wall member. According to the configuration, the gas heated by the heating unit may be less likely to be discharged to the outside of the apparatus from a gap between the support surface and the side wall members. That is, heat efficiency is improved.

A heating apparatus advantageous for the issue described above is a heating apparatus disposed at a position opposite to a support surface configured to support a medium onto which a liquid is adhered by a recording unit. The support surface supports the medium in a transporting direction in which a medium is transported. The support surface is positioned downstream of the recording unit. The heating apparatus may include a heating unit configured to heat the medium supported by the support surface, a flow channel having an inlet and an outlet opening toward the support surface, and a blower disposed in the flow channel and configured to allow a gas entering via the inlet to blow from the outlet. The inlet opens to allow at least some of the gas blowing from the outlet to enter. The outlet is located on a side of the recording unit with respect to the inlet, and, in the blowing direction, faces the side of the inlet in a direction along the support surface. This configuration thus provides a similar advantage as with the medium processing apparatus described above.

A medium processing method advantageous for the issue described above is a medium processing method configured to dry, in a medium processing apparatus including a flow channel disposed away from an inclined surface, the medium supported by the inclined surface. The method may include heating a gas, allowing or causing the heated gas to flow from vertical upside to vertical downside along the inclined surface, allowing or causing the flowing gas to enter into the flow channel, and allowing or causing the gas to circulate.

According to the method, the heated gas may be less likely to flow vertically upward along the inclined surface. That is, for example, even when the recording unit is located above the medium, vapor generated through drying may be less likely to flow toward the recording unit. The vapor is thus suitably discharged.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

As an example of a medium processing apparatus, an exemplary embodiment of a recording apparatus will now be described herein with reference to the accompanying drawings. The recording apparatus may be, for example, an ink-jet type printer configured to eject a liquid (an ink is an example of a liquid) onto a medium, such as a sheet of paper, to record an image. The image may include characters, photographs, and the like.

Figure 1:
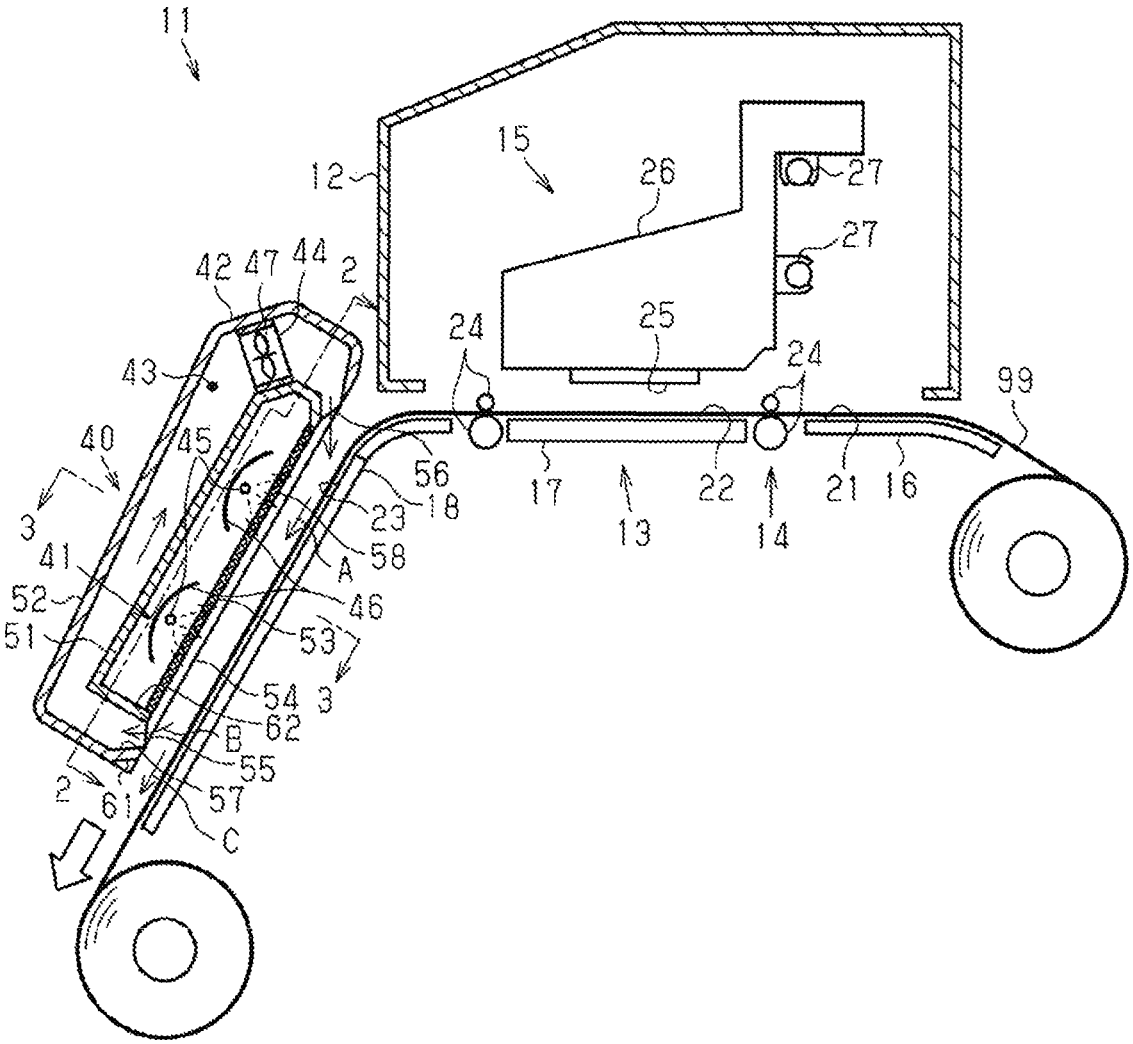
FIG. 1 is a schematic side view of a recording apparatus according to one exemplary embodiment.

As illustrated in FIG. 1, the recording apparatus (medium processing apparatus) 11 includes an accommodation body 12, a supporting unit 13 configured to support a medium 99, a transporting unit 14 configured to transport the medium 99 along the supporting unit 13, a recording unit 15 disposed in the accommodation body 12, and a heating apparatus 40. The heating apparatus 40 is disposed outside the accommodation body 12 and may be separate from the accommodation body 12. The heating apparatus 40 may be configured to heat the medium 99 to which liquid is impinged by the recording unit 15. In other words, the heating apparatus 40 may heat both the medium 99 and the liquid or ink that has been impinged onto the medium 99. The liquid may adhere to the medium 99 or be at least partially absorbed by the medium 99. The medium 99 may be cylindrically wound, rolled paper, for example. The medium 99 is unrolled during processing and may be rolled up into a rolled paper at the end of processing.

The supporting unit 13 includes a first support plate 16, a second support plate 17, and a third support plate 18. The first support plate 16, the second support plate 17, and the third support plate 18 are arranged in order in a transporting direction of the medium 99 to be transported by the transporting unit 14. The first support plate 16 is upstream, with respect to the transporting direction, of the second support plate 17 and the second support plate 17 is upstream of the third support plate 18.

The first support plate 16 and the second support plate 17 both face the accommodation body 12. Respective surfaces of the first and second support plates 16 and 17 face the accommodation body 12 and serve as support surfaces 21 and 22 configured to support the medium 99. The first and second support plates 16 and 17 support the medium 99 when recording is performed by the recording unit 15. The third support plate 18 faces the heating apparatus 40. A surface of the third support plate 18 faces the heating apparatus 40 to serve as a support surface 23 configured to support the medium 99. In the exemplary embodiment, the support surfaces 21, 22, and 23 of the first, second, and third support plates 16, 17, and 18 faces vertically upward. In one example, a portion of the first support plate 16 may not directly face the accommodation body 12. Further, this portion may be curved such that a portion of the support surface 21 closer to the roll body may face a different direction from the portion of the support surface 21 facing the accommodation body 12.

The transporting unit 14 includes, for example, a plurality of a transport rollers 24 configured to come into contact with the medium 99, to rotate, and to transport the medium 99. In the exemplary embodiment, the transport rollers 24 are disposed, in the transporting direction of the medium 99, between the first support plate 16 and the second support plate 17, and between the second support plate 17 and the third support plate 18. The transporting direction of the medium 99 to be transported by the transporting unit 14 is a direction along the support surface 21 of the first support plate 16, the support surface 22 of the second support plate 17, and the support surface 23 of the third support plate 18. Note that in the exemplary embodiment, the transporting unit 14 includes a plurality of the transport rollers 24. However, as long as a configuration transports the medium 99, the configuration may include a single transport roller 24.

The recording unit 15 includes a head 25 configured to eject a liquid, a carriage 26 configured to hold the head 25, and a guide shafts 27 configured to guide the carriage 26 during movement of the carriage 26. The liquid to be ejected from the head 25 may be an ink, for example. The head 25 faces the second support plate 17, and ejects the liquid onto the medium 99 supported by the second support plate 17. As the recording unit 15 ejects the liquid onto the medium 99, an image is recorded onto the medium 99. The head 25 is configured to move back and forth, together with the carriage 26, along the guide shafts 27. The guide shafts 27 extend in a width direction of the medium 99 and the liquid is ejected as the head 25 moves back and forth. Note that the width direction of the medium 99 is a different direction from the transporting direction of the medium 99.

The heating apparatus 40 is configured to heat the medium 99 on which the liquid is impinged by the recording unit 15 to allow the liquid (or portions or components thereof) impinged onto the medium 99 to evaporate through heating to dry the medium 99.

The third support plate 18 supports the medium 99 downstream of the recording unit 15 in the transporting direction of the medium 99. That is, the support surface 23 of the third support plate 18 supports the medium 99 onto which liquid has been ejected by the recording unit 15. The third support plate 18 according to the exemplary embodiment extends diagonally from upstream to downstream, i.e., extends from vertical upside to vertical downside, in the transporting direction of the medium 99. That is, an upstream part of the third support plate 18 in the transporting direction is located above a downstream part of the third support plate 18. For this reason, the support surface 23 of the third support plate 18 is an inclined surface. A portion of the third support plate 18, for example an upstream portion, may be curved. Thus, the surface may transition from horizontal to inclined.

The heating apparatus 40 faces the support surface 23 of the third support plate 18. The heating apparatus 40 is disposed away or separated from the support surface 23. For this reason, the arrangement allows the medium 99 transported by the transporting unit 14 to pass through a region between the support surface 23 and the heating apparatus 40. The heating apparatus 40 heats the medium 99 having an image recorded thereon by the recording unit 15 and transported by the transporting unit 14.

Figure 2:
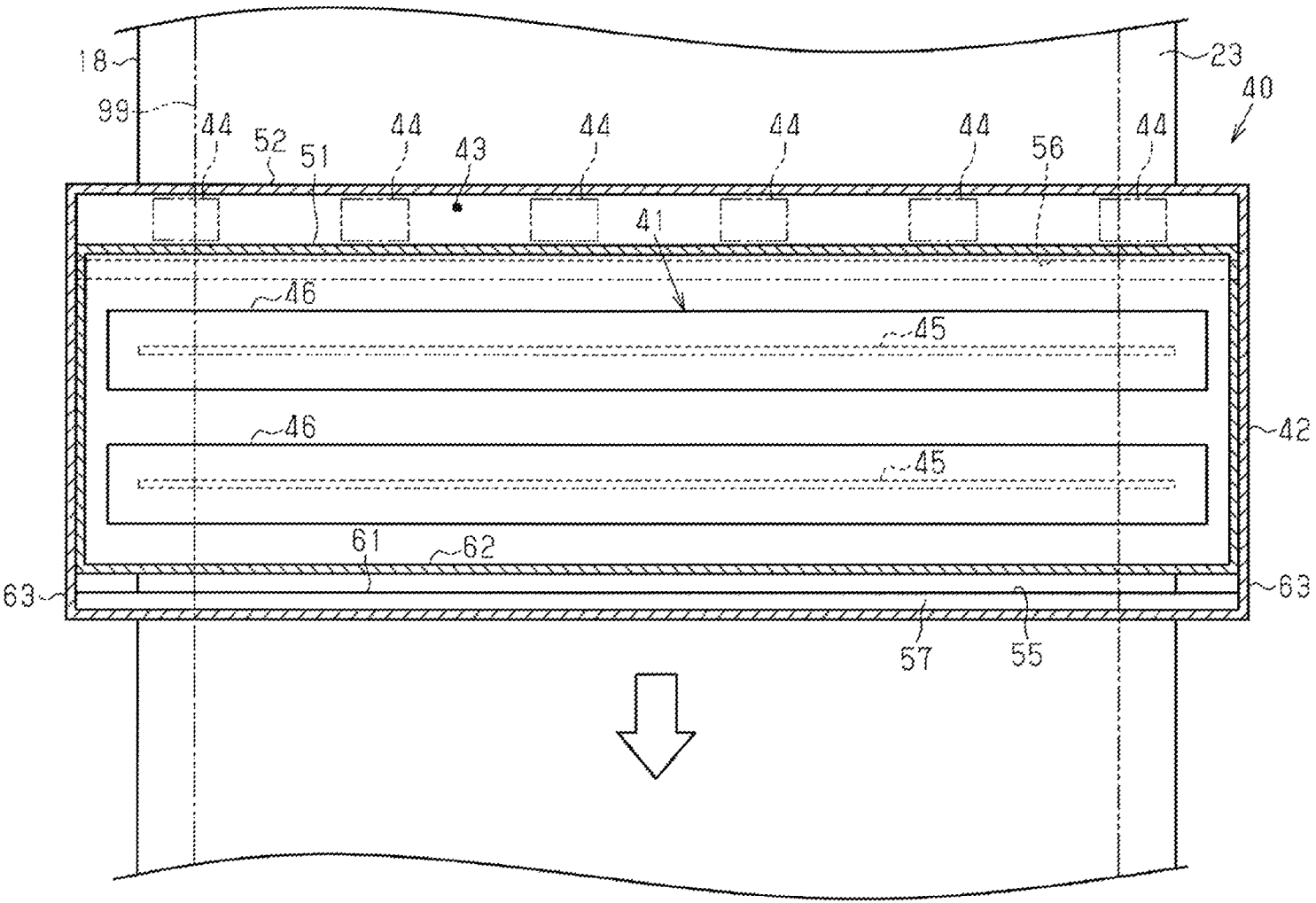
FIG. 2 is a cross-sectional diagram taken along line 2-2 indicated by arrows in FIG. 1.

As illustrated in FIGS. 1 and 2, the heating apparatus 40 includes a heating unit 41 configured to heat the medium 99, a housing 42 configured to accommodate the heating unit 41, a flow channel 43 configured to allow a gas to flow or through which a gas may flow, and a blower 44 configured to blow the gas. The heating unit 41 is disposed to face the support surface 23 to heat the medium 99 supported by the support surface 23. The heating unit 41 includes heater pipes 45 extending in the width direction of the medium 99 and serving as heating elements. The heating unit 41 may also include a reflector plate 46 configured to reflect heat of or generated by the heating elements. A plurality of the heater pipes 45 are disposed along the support surface 23. The reflector plates 46 respectively cover the heater pipes 45 from above (or on a side opposite from the support surface 23) to reflect an infrared ray generated from the heater pipes 45 toward the support surface 23. Note that in the exemplary embodiment, the heater pipes 45 serve as heating elements. However, any heating member may be used.

The housing 42 includes an inner wall 51 surrounding the heating unit 41, and an outer wall 52 surrounding the inner wall 51. The outer wall 52 is disposed outside the inner wall 51. The inner wall 51 and the outer wall 52 define box shapes opening toward the support surface 23. The inner wall 51 and the outer wall 52 respectively have openings 53 and 54 facing the support surface 23. The inner wall 51 is disposed to allow its side walls in the width direction of the medium 99 to abut side walls of the outer wall 52 (see FIG. 2). For this reason, the side walls of the outer wall 52 configure side walls of the housing 42. Note that the side walls of the inner wall 51 and the side walls of the outer wall 52 may be integrated with each other (a single wall may be formed instead). In addition, the side walls of the housing 42 may be detachable from other wall members configuring the housing 42. The inner wall 51 and the outer wall 52 define the flow channel 43.

The flow channel 43 is a region outside the inner wall 51 and inside the outer wall 52. The flow channel 43 surrounds, at least partially in one embodiment, the heating unit 41. The flow channel 43 has an inlet 55 and an outlet 56 opening toward the support surface 23. Respective members configuring edges of the inlet 55 and the outlet 56 are parts of the inner wall 51 and the outer wall 52.

The outlet 56 is located on a side of the recording unit 15 with respect to the inlet 55. In other words, the outlet 56 is nearer to the recording unit than the inlet 55 is. That is, the outlet 56 is located upstream, in the transporting direction, of the inlet 55. The outlet 56 according to the exemplary embodiment may also be located above the inlet 55. The outlet 56 faces an upstream part of the support surface 23 in the transporting direction. The inlet 55 faces a downstream part of the support surface 23 in the transporting direction.

The blower 44 is disposed in the flow channel 43. The blower 44 includes a fan 47 configured to generate an air current by rotating. A plurality of the blowers 44 may be disposed and arranged in the width direction of the medium 99 in the flow channel 43.

The blower 44 is disposed such that it allows or causes a gas in the flow channel 43 to flow toward the outlet 56. The gas in the flow channel 43 is air, for example. The gas flows from the blower 44 along the flow channel 43 and blows from the outlet 56. That is, the blower 44 allows the gas entering from the inlet 55 to be blown out from the outlet 56. At this time, air blown out from the outlet 56 is mostly blown out along an extending direction of the members configuring the outlet 56. That is, a blowing direction of the outlet 56 is defined by the extending direction of the members configuring the outlet 56.

The outlet 56 is shaped so that the blowing direction of the outlet 56 goes toward at least an inlet side in a direction along the support surface 23. The inlet side is the side on which the inlet 55 is located. In other words, the outlet 56 is facing an area in which the inlet 55 is located in the direction along the support surface 23. In other words, a downstream part of the flow channel 43 is coupled to the outlet 56, and the downstream part extends diagonally toward the support surface 23. In addition, the outlet 56 according to the exemplary embodiment opens toward a downstream direction of the transporting direction. For this reason, the gas blown out from the outlet 56 mostly flows toward the inlet side of along the support surface 23. That is, the gas blown out from the outlet 56 flows in the transporting direction of the medium 99 on the support surface 23, as illustrated by arrow A in FIG. 1. In the exemplary embodiment, the gas blown out from the outlet 56 flows from vertical upside to vertical downside along the support surface 23.

As illustrated by arrow B in FIG. 1, some of the gas blown out from the outlet 56 enters, from the inlet 55, into the flow channel 43. As illustrated by arrow C in FIG. 1, some of the gas blown out from the outlet 56 passes through between the inlet 55 and the support surface 23 and is discharged to the outside of the heating apparatus 40. The heating apparatus 40 is configured to allow some of the gas blown out from the outlet 56 to circulate inside the heating apparatus 40 via the flow channel 43. For this reason, the inlet 55 may open to allow at least some of the gas blown out from the outlet 56 to enter and be circulated.

The heating apparatus 40 heats the medium 99 supported by the support surface 23, and sprays or blows the gas onto the medium 99 to dry the medium 99. That is, when the medium 99 having undergone recording is transported along the supporting unit 13, and reaches the drying region between the heating apparatus 40 and the support surface 23, a heat generated by the heater pipes 45 and the gas blown out from the outlet 56 facilitate evaporation of the liquid impinged onto the medium 99. In other words, the recording apparatus (medium processing apparatus) 11 dries the medium 99 supported by the support surface 23.

As the heating unit 41 heats the medium 99, a vapor is generated by the evaporation of the liquid impinged onto the medium 99. As the vapor stagnates on a surface of the medium 99, the liquid impinged onto the medium 99 may not fully evaporate. In other words, the stagnation of the vapor may prevent the liquid present on the medium 99 from evaporating sufficiently. The heating apparatus 40 sprays or blows the gas onto the medium 99 to move the vapor from the surface of the medium 99 to facilitate evaporation of the liquid impinged onto the medium 99. As described above, the heating apparatus 40 dries the medium 99 on which the liquid is impinged.

Some of the gas blown out from the outlet 56 and passed through the drying region enters, from the inlet 55, into the flow channel 43. Since the gas entering from the drying region into the flow channel 43 is heated, the heating apparatus 40 may be less likely to become cold internally, compared with a case where a gas outside the drying region enters into the inlet 55. That is, a temperature of the gas blown out from the outlet 56 easily rises, allowing a temperature inside the heating apparatus 40 to efficiently rise. With the flow channel 43 disposed to surround the heating unit 41, the heat generated by the heating unit 41 causes a temperature inside the flow channel 43 to raise. As described above, heat generated by the heater pipes 45 is collected and reused for drying, suppressing a heat loss in the heating apparatus 40, and improving heat efficiency in the heating apparatus 40. In summary, the recording apparatus (medium processing apparatus) 11 configured to execute the drying process to heat a gas, allows the heated gas to flow from vertical upside to vertical downside along the support surface 23 being inclined, allows the flowing gas to enter into the flow channel 43, and allows the gas to circulate. With this configuration, the recording apparatus (medium processing apparatus) 11 dries the medium 99.

An opening area of the outlet 56 may be smaller than an opening area of the inlet 55. In this case, the gas blown out from the outlet 56 has higher velocity than the gas entering, from the inlet 55, into the flow channel 43. With the increased velocity of the gas sprayed or blown onto the medium 99, vapor stagnating on the surface of the medium 99 may be more easily removed.

The opening areas of the inlet 55 and the outlet 56 change depending on a distance between the inner wall 51 and the outer wall 52. For example, compared with the case illustrated in FIG. 1, when the inner wall 51 is located further upstream, in the transporting direction, the opening area of the inlet 55 increases, while the opening area of the outlet 56 decreases.

When vapor generated from the medium 99 is removed with the gas blown out from the outlet 56, the vapor may enter into the inlet 55 together with some of the gas blown out from the outlet 56. When an amount of the vapor entering into the inlet 55 increases, humidity inside the heating apparatus 40 may easily increase as the vapor circulates inside the heating apparatus 40. As the humidity inside the heating apparatus 40 increases, the medium 99 may not dry fully. For this reason, the heating apparatus 40 may allow the vapor generated from the medium 99 (by evaporation of the liquid ejected onto the medium 99) to be discharged to the outside of the heating apparatus 40 together with some of the gas blowing from the outlet 56.

By spraying or blowing the gas from the outlet 56 onto the medium 99 supported by the support surface 23, the vapor generated from the medium 99 is pressed onto the support surface 23, and flows in the transporting direction. In other words, with the gas blowing from the outlet 56, the vapor generated from the medium 99 may be less likely to flow vertically upward. The gas containing vapor generated from the medium 99 easily flows toward the inlet 55 along the support surface 23, passes through between the inlet 55 and the support surface 23 together with some of the gas blown out from the outlet 56, and is discharged to the outside of the heating apparatus 40. By blowing the vapor against the surface of the medium 99, the vapor is more likely to be discharged between the inlet 55 and the medium support surface 23 to the outside of the heating apparatus. In the exemplary embodiment, to effectively remove and discharge vapor generated from the medium 99, a velocity of a gas blowing from the outlet 56 may be approximately 2 m/s or faster.

The inlet 55 may open toward the outlet 56. An upstream part of the flow channel 43 is coupled to the inlet 55, and may extend diagonally toward the support surface 23. The inlet 55 extends in a diagonal direction that is different from the diagonal direction in which the outlet 56 extends. The inlet 55 according to the exemplary embodiment opens to face upstream in the transporting direction. With the inlet 55 facing an outlet side on which the outlet 56 is located, the gas blown out from the outlet 56 easily enters into the inlet 55. With the configuration, the heating apparatus 40 easily allows the gas heated by the heating unit 41 to circulate, to improve heat efficiency.

The inlet 55 may have a guide face 57. With the rake face 57, the gas easily enters, from the inlet 55, into the flow channel 43. The rake face 57 is a surface inclined relative to the support surface 23 and extending toward the outlet side. The guide face 57 functions to guide the gas blown out from the outlet 56 and flowing toward the inlet side along the support surface 23 upward. With the configuration, the gas heated by the heating unit 41 easily circulates, to improve heat efficiency.

A ratio between an amount of the gas entering into the inlet 55 and an amount of the gas being discharged from the heating apparatus 40 may be 8:2. Accordingly, while a temperature in the apparatus is kept higher, the ratio allows vapor generated from the medium 99 to be discharged to the outside of the apparatus.

The heating unit 41 may be disposed between the inlet 55 and the outlet 56. The heating unit 41 disposed between the inlet 55 and the outlet 56 allows the gas blown out from the outlet 56 to pass through the region heated by the heating unit 41. For this reason, the heating unit 41 effectively heats the gas blown out from the outlet 56. In addition, the heating unit 41 faces the medium 99 supported by the support surface 23, and thus directly heats the medium 99, to improve drying efficiency. In one example, the medium 9 is dried by the flowing gas, which may be heated gas, and by direct heat.

A metallic mesh 58 may be disposed over the opening 53 of the inner wall 51. With this configuration, the metallic mesh 58 transmits heat of the heater pipes 45 to the medium 99 on the support surface 23. In one embodiment, the metallic mesh 58 allows the heat from the heater pipes 45 to pass through the mesh 58 and reach the medium 99. In addition, with the metallic mesh 58, an air current flowing along the support surface 23 from the outlet 56 to the inlet 55 is controlled to flow along the metallic mesh 58. In the exemplary embodiment, the metallic mesh 58 is used. However, any member configured to guide the gas in a direction from the outlet 56 to the inlet 55 may be used. In this case, the member may have a structure that does not excessively prevent heat generated from the heater pipes 45 from transmitting to the support surface 23.

Figure 3:
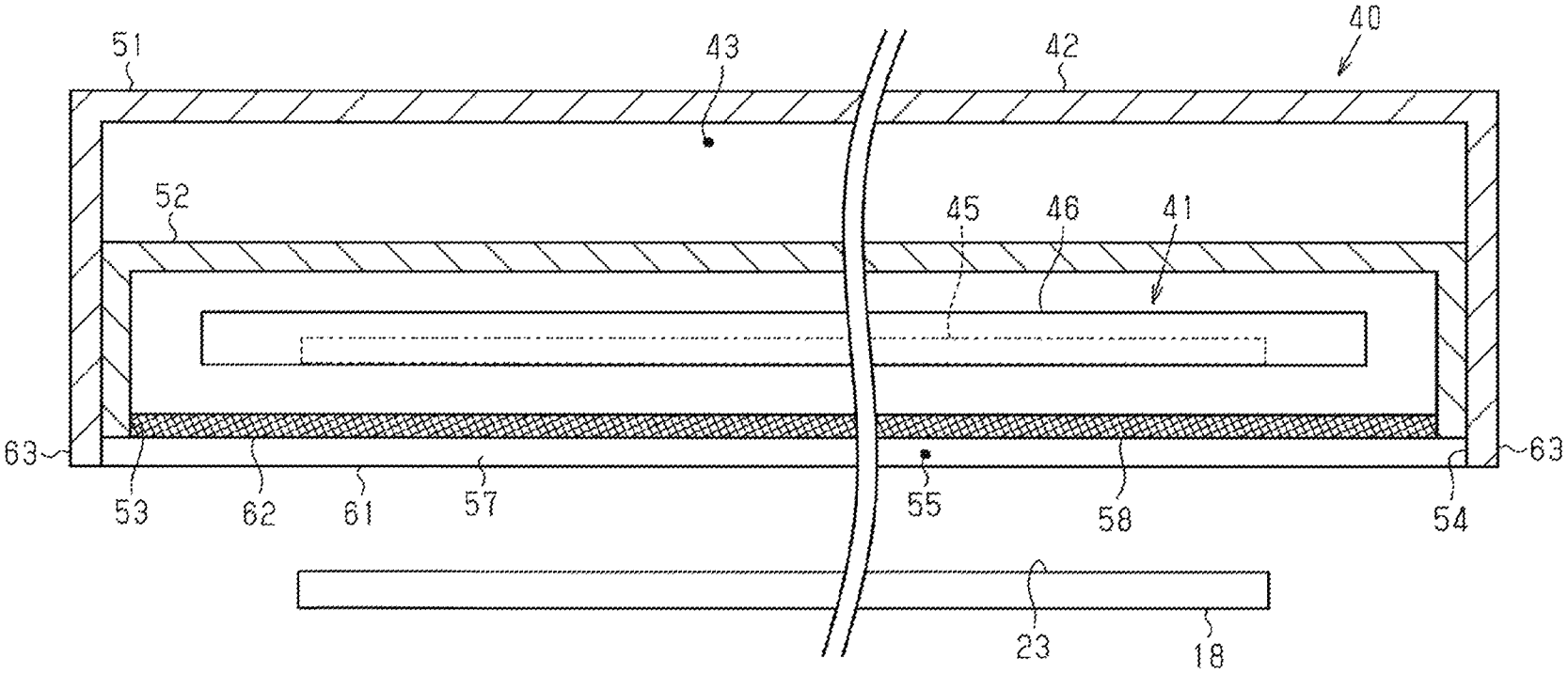
FIG. 3 is a cross-sectional diagram taken along line 3-3 indicated by arrows in FIG. 1.

As illustrated in FIGS. 2 and 3, the inlet 55 may be formed surrounded by a first wall member 61, a second wall member 62, and side wall members 63 that are a part of the housing 42. The first and second wall members 61 and 62 and the side wall members 63 define the upstream part of the flow channel 43 coupled to the inlet 55.

The first wall member 61 is a part of the outer wall 52. The second wall member 62 is a part of the inner wall 51. The second wall member 62 faces the first wall member 61. The side wall members 63 are parts of the outer wall 52. The side wall members 63 respectively have surfaces intersecting with the first and second wall members 61 and 62, and are coupled to the first and second wall members 61 and 62. The first wall member 61 has the guide face 57 on a side facing the second wall member 62. For this reason, some of the gas blowing from the outlet 56 and being discharged to the outside of the apparatus passes through a gap between the first wall member 61 and the support surface 23.

The outer wall 52 may be disposed to allow the opening 54 to be located at a position closer to the support surface 23 than the opening 53 of the inner wall 51. That is, the side wall members 63 defining the inlet 55 may extend up to the position closer to the support surface 23 than the second wall member 62. With this configuration, some of the gas blown out from the outlet 56 may be less likely to pass through a gap between the support surface 23 and the side wall members 63, and to be discharged to the outside of the heating apparatus 40. As a result, the gas blown out from the outlet 56 easily enters into the inlet 55, to further improve heat efficiency of the heating apparatus 40.

The first wall member 61 may extend up to a position closer to the support surface 23 than the second wall member 62. With this configuration, the inlet 55 opens toward the outlet side. With this configuration, some of the gas blown out from the outlet 56 may be less likely to pass through the gap between the first wall member 61 and the support surface 23, and to be discharged to the outside of the heating apparatus 40. As a result, the gas blown out from the outlet 56 easily enters into the inlet 55, the amount of the gas entering from outside the inlet 55 of the heating apparatus 40 into the inlet 55 is reduced, and the heat efficiency of the heating apparatus 40 is further improved.

Next, how the recording apparatus 11 and the heating apparatus 40 act or operate will now be described herein.

When the heating apparatus 40 heats the medium 99, and when vapor generated from the medium 99 (by evaporation of the liquid) enters into the accommodation body 12 of the recording apparatus 11, the vapor may condense onto the head 25 of the recording unit 15, resulting in water droplets forming on the head 25. The water droplets formed on the head 25 may negatively affect the recording quality of the recording unit 15. In general, vapor is lighter in density than air. The vapor thus easily flows upward due to its buoyancy. For this reason, in particular, in the configuration described in the exemplary embodiment, where the support surface 23 diagonally extends from upward to downward from upstream to downstream in the transporting direction, vapor generated from the medium 99 may be likely to flow toward the outlet 56. That is, the vapor easily flows toward the recording unit 15 located upstream, in the transporting direction, of the outlet 56.

The recording apparatus 11 is configured to allow the gas blown out from the outlet 56 to flow toward an area opposite to or away from the recording unit 15. That is, the outlet 56 allows the gas to be blown out toward the inlet side, the direction from the outlet 56 toward the inlet side being opposite to the direction from the outlet 56 toward a recording unit side, to prevent vapor from flowing toward the recording unit side. The gas blown out from the outlet 56 causes the vapor to be discharged, from the inlet side, to the outside of the heating apparatus 40. For this reason, the vapor is less likely to pass through between the outlet 56 and the support surface 23, and to flow toward the recording unit 15. The gas blown out from the outlet 56 serves as an air curtain, resulting in that the vapor may be less likely to flow toward the side of the recording unit 15.

According to the exemplary embodiment described above, the following advantages are obtained.

1. The gas is blown out from the outlet 56 toward the inlet 55, which located opposite to or further away from the recording unit 15. For this reason, the gas blown out from the outlet 56 causes vapor generated from the medium 99 heated by the heating unit 41 to flow toward the area opposite to or away from the recording unit 15 along the support surface 23, to pass through between the inlet 55 and the support surface 23, and to be discharged to the outside of the apparatus. According to the exemplary embodiment described above, when the recording unit 15 located on the outlet side of the outlet 56 with respect to a region heated by the heating apparatus 40 (heating unit 41), vapor generated from the medium 99 may be less likely to flow from the region heated by the heating apparatus 40 (heating unit 41) toward the recording unit 15. The vapor is thus suitably discharged.

2. The inlet 55 opens toward the outlet side. According to the configuration, the gas blown out from the outlet 56 easily enters, from the inlet 55, into the flow channel 43. In particular, as the gas heated by the heating unit 41 tends to flow upward, in the exemplary embodiment, the gas easily enters, from the inlet 55 opening toward the support surface 23, into the flow channel 43. For this reason, some of the gas heated by the heating unit 41 passes through the flow channel 43 and circulates inside the apparatus. Meanwhile, the gas blown out from the outlet 56 presses vapor generated from the medium 99 supported by the support surface 23 onto the support surface 23 to allow the vapor to flow and be discharged to the outside of the apparatus. With improved heat efficiency, this feature suitably allows the vapor to be discharged.

3. The inlet 55 may be provided with the guide face 57, which is inclined relative to the support surface 23 and extends toward the outlet 56 to allow the gas blown out from the outlet 56 to easily enter. The rake guide 57 scoops the gas blown out from the outlet 56 to allow the gas to easily enter into the inlet 55. In particular, as the gas heated by the heating unit 41 tends to flow upward, in the exemplary embodiment, the gas easily enters into the inlet 55, which opens toward the support surface 23. For this reason, some of the gas heated by the heating unit 41 passes through the flow channel 43 and circulates inside the apparatus. Meanwhile, the gas blown out from the outlet 56 presses vapor generated from the medium 99 onto the support surface 23 to allow the vapor to flow and be discharged to the outside of the apparatus. With improved heat efficiency, this feature suitably allows the vapor to be discharged.

4. The heating unit 41 is disposed between the outlet 56 and the inlet 55. The gas blown out from the outlet 56 passes through the region heated by the heating unit 41. For this reason, the heating unit 41 effectively heats the gas blowing from the outlet 56. This feature improves heat efficiency.

5. An opening area of the outlet 56 is configured to be smaller than an opening area of the inlet 55. According to the configuration, a velocity of a gas blown out from the outlet 56 is increased. For this reason, vapor generated from the medium 99 may be less likely to be discharged, from the outlet side, to the outside of the apparatus.

6. The side wall members 63 extend up to the position closer to the support surface 23 than the second wall member 62. In other words, the side wall members 63 are closer to the support surface 23 than the second wall member 62. According to the configuration, the gas heated by the heating unit 41 may be less likely to be discharged externally from the gap between the support surface 23 and the side wall members 63. That is, heat efficiency is improved.

7. The recording apparatus (medium processing apparatus) 11, configured to execute a drying process to heat a gas, allows or causes the heated gas to flow from vertical upside to vertical downside along the support surface (inclined surface) 23, allows or causes the flowing gas to enter into the flow channel 43, and allows or causes the gas to circulate. For this reason, the heated gas may be less likely to flow vertically upward along the support surface (inclined surface) 23. That is, when the recording unit 15 is located above the medium, for example, vapor generated through drying the medium may be less likely to flow toward the recording unit 15. The vapor is thus suitably discharged.

Note that the exemplary embodiment described above may be modified as follows. The following modifications described below may be combined with each other as appropriate.

The inlet 55 is not limited to the configuration where the inlet 55 opens toward the support surface 23. For example, the inlet 55 may open toward the outlet 56, where the first wall member 61 defining the inlet 55 extends along the support surface 23.

The heating unit 41 may be disposed in the flow channel 43. In this case, the gas heated in the flow channel 43 is sprayed or blown onto the medium 99 to dry the medium 99.

The housing 42 may be configured to have the inner wall 51 and the outer wall 52 integrated each other.

The guide face 57 may be a curved surface.

The guide face 57 may not be provided. That is, the first wall member 61 may extend vertically toward the support surface 23.

The support surface 23 facing the heating apparatus 40 may be a surface extending horizontally or a curved surface.

The heating apparatus 40 may be detachably attached to the recording apparatus 11.

The heating apparatus 40 may be accommodated in the accommodation body 12 of the recording apparatus 11.

The blower 44 may be disposed at either of the inlet 55 and the outlet 56.

The heating elements included in the heating unit 41 are not limited to the heater pipes 45, but may be a heating wire or a heating lamp and the like, for example.

The liquid to be sprayed or ejected from the recording unit 15 is not limited to an ink and, for example, may be a liquid material obtained by dispersing or mixing particles of a functional material in liquid, or the like. For example, the recording unit 15 may jet a liquid material, which includes a material such as an electrode material, a color material (pixel material), and the like, used in the manufacture of liquid crystal displays, electroluminescence (EL) displays, surface emitting displays, and the like in a dispersed or dissolved form.

The recording unit 15 may be configured to come into contact with the medium 99 to impinge a liquid onto the medium 99.

The recording unit 15 may be a line head type extending longer in the width direction of the medium 99.

The recording apparatus 11 may be a page printer configured to perform printing per page.

The heating apparatus 40 may be used to facilitate drying of other objects than printed materials.

The medium 99 is not limited to a sheet of paper, but may be a plastic film such as a transfer film, a thin plate material, a textile used in a textile printing apparatus, and the like, for example.

What is claimed is:

1. A medium processing apparatus comprising:

a support surface configured to support a medium, wherein a liquid is impinged to the medium by a recording unit, wherein the medium is transported in a transporting direction, wherein the support surface is configured to support the medium downstream than the recording unit in the transporting direction;

an inner wall;

an outer wall;

a heating unit configured to heat the medium supported by the support surface;

a flow channel including an inlet and an outlet, the inlet and the outlet opening toward the support surface; and a blower disposed in the flow channel and configured to allow a gas entering via the inlet to be blown out from the outlet, wherein the inner wall houses the heating unit, the outer wall houses the inner wall and the blower, the flow channel is defined by an outer surface of the inner wall and an inner surface of the outer wall, the inlet opens to allow at least some of the gas blown out from the outlet to enter the flow channel and circulate along the outer surface of the inner wall and the inner surface of the outer wall toward the blower, the outlet is nearer to the recording unit than the inlet is, and a blowing direction of the outlet goes toward at least an inlet side on which the inlet is located in a direction along the support surface.

2. The medium processing apparatus according to claim 1, wherein the inlet opens toward an outlet side on which the outlet is located.

3. The medium processing apparatus according to claim 1, wherein the inlet is provided with a guide face that inclines relative to the support surface and that extends toward an outlet side on which the outlet is located.

4. The medium processing apparatus according to claim 1, wherein the gas blown out from the outlet passes through a region heated by the heating unit.

5. The medium processing apparatus according to claim 4, wherein the heating unit is disposed at a position opposite to the support surface.

6. The medium processing apparatus according to claim 4, wherein the heating unit is disposed in the flow channel.

7. The medium processing apparatus according to claim 1, wherein an opening area of the outlet is smaller than an opening area of the inlet.

8. The medium processing apparatus according to claim 1, comprising:

a housing configured to accommodate the heating unit, wherein the inlet includes:

a first wall member configuring a part of the housing;

a second wall member that is located on the outlet side than the first wall member and configuring a part of the housing; and side wall members intersecting with the first wall member and the second wall member and configuring parts of the housing, the side wall members extending up to a position closer to the support surface than a position of the second wall member.

9. The medium processing apparatus according to claim 8, wherein a distance between the side wall members is longer than a length of the support surface in a width direction intersecting with the transporting direction.

10. The medium processing apparatus according to claim 1, comprising:

a plurality of the blowers arranged in a width direction intersecting with the transporting direction.

11. A heating apparatus disposed to face a support surface, the support surface being configured to support the medium, and positioned downstream than the recording unit in a transporting direction in which a medium to which a liquid impinged by the recording unit is transported, the heating apparatus comprising:

an inner wall;

an outer wall;

a heating unit configured to heat the medium supported by the support surface;

a flow channel including an inlet and an outlet, the inlet and outlet opening toward the support surface; and a blower disposed in the flow channel and configured to allow a gas entering via the inlet to be blown out from the outlet, wherein the inner wall houses the heating unit, the outer wall houses the inner wall and the blower, the flow channel is defined by an outer surface of the inner wall and an inner surface of the outer wall, the inlet opens to allow at least some of the gas blown out from the outlet to enter the flow channel and circulate along the outer surface of the inner wall and the inner surface of the outer wall toward the blower, the outlet is nearer to the recording unit than the inlet is, and a blowing direction of the outlet goes toward at least an inlet side on which the inlet is located in a direction along the support surface.

12. A medium processing method configured to dry, in a medium processing apparatus including a flow channel disposed away from an inclined surface, the medium supported by the inclined surface, the method comprising:

heating a gas by a heating unit;

blowing the heated gas, by a blower, to cause the heated gas to flow from a vertical upside to a vertical downside along the inclined surface;

causing the flowing gas to enter into the flow channel; and causing the gas to circulate, wherein the flow channel is defined by an outer surface of an inner wall and an inner surface of an outer wall, the inner wall houses the heating unit, and the outer wall houses the inner wall and the blower.

* * * * *